United States Patent [19]

Corry

[11] Patent Number: 4,493,128

[45] Date of Patent: Jan. 15, 1985

[54] WINDOW SASH POSITIONER

[75] Inventor: Jon C. Corry, Hueytown, Ala.

[73] Assignee: Mason Corporation, Birmingham, Ala.

[21] Appl. No.: 506,284

[22] Filed: Jun. 20, 1983

[51] Int. Cl.[3] ..... E05D 13/08; E05D 17/00

[52] U.S. Cl. ..... 16/197; 16/193; 49/417; 49/421

[58] Field of Search ..... 16/193, 197, 199; 248/297.3; 49/417, 421

[56] References Cited

U.S. PATENT DOCUMENTS

| | | | |
|---|---|---|---|
| 2,143,266 | 1/1939 | Grondahl | 16/DIG. 6 |
| 2,543,785 | 3/1951 | Lermont | 16/DIG. 6 |
| 3,280,511 | 10/1966 | Johnson | 16/197 X |
| 3,501,867 | 3/1970 | Scott | 16/193 X |

*Primary Examiner*—Fred Andrew Silverberg
*Attorney, Agent, or Firm*—Woodford R. Thompson, Jr.

[57] ABSTRACT

A positioner for a movable window sash embodies a guide bracket carried by the sash with one side of the guide bracket spaced from and facing an adjacent side of a window frame and extending in a plane which is inclined relative to a plane extending in the direction of movement of the sash with the opposite side of the guide bracket being parallel to said one side thereof. A wedge-like member has a first surface in sliding engagement with said one side of the guide bracket. A second surface of the wedge-like member extends parallel to and faces the adjacent side of a window frame and is movable into and out of engagement with the window frame in response to sliding movement of the wedge-like member in opposite directions. An actuator mounted for sliding movement along said opposite side of the guide bracket is operatively connected to the wedge-like member to move it in opposite directions. A resilient member urges the wedge-like member into engagement with the adjacent side of the window frame.

6 Claims, 8 Drawing Figures

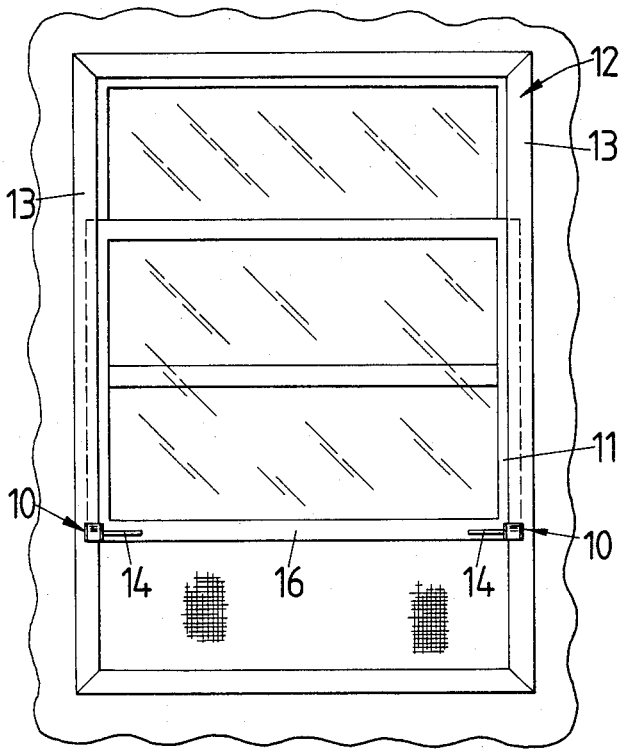
FIG. 1
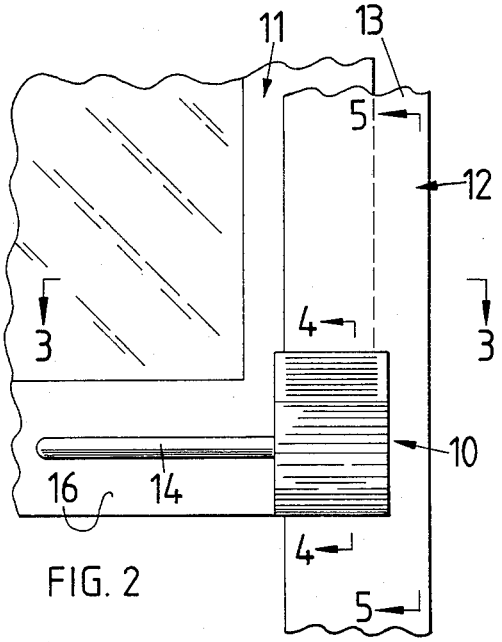
FIG. 2
FIG. 3
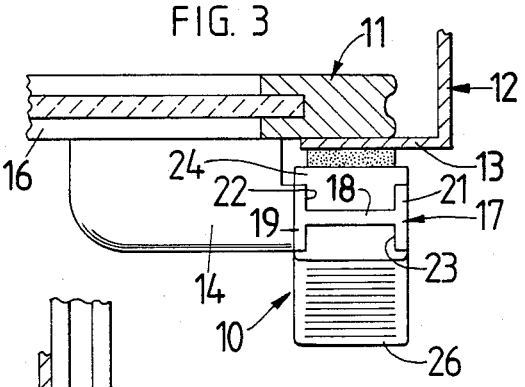
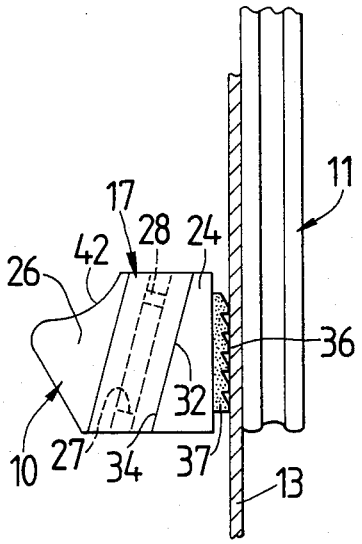
FIG. 5
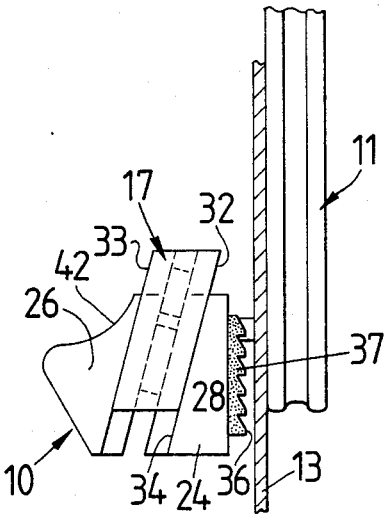
FIG. 6
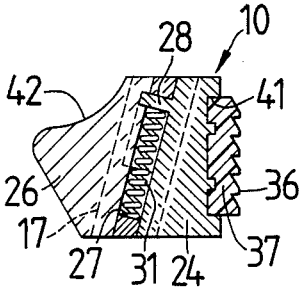
FIG. 4

WINDOW SASH POSITIONER

BACKGROUND OF THE INVENTION

This invention relates to a window sash positioner and more particularly to such a positioner which is adapted to retain a window sash at any selected position at it is moved relative to the side members of its window frame.

Heretofore in the art to which my invention relates, many devices have been proposed for retaining a window sash at selected positions relative to its window frame. Such devices have not only been complicated in structure and expensive to manufacture, but many of such devices can cause damage to the components of a window as the sash is raised or lowered and secured in selected positions along the window frame. U.S. Pat. No. 293,310 to Clements and U.S. Pat. No. 1,715,990 to Chaffee disclose screw-like members which are employed to retain the window sash at selected positions. U.S. Pat. Nos. 336,932 to McCall, 2,612,398 to Miller and 3,905,626 to Myers all disclose devices which are adapted for pivotal movement into and out of locking position whereby the window sash is locked at a selected position.

An object of my invention is to provide a window sash positioner which includes a movable locking element having a contact surface adapted to move into and out of engagement with an adjacent side member of a window frame with the contact surface facing the adjacent side member of the window frame and extending parallel thereto at all times as the contact surface moves into and out of engagement with the adjacent side member, thus providing maximum contact area between the locking element and the adjacent side member.

Another object of my invention is to provide a positioner for a movable window sash which is extremely simple of construction, economical of manufacture, and one which may be readily installed on conventional window frames having spaced apart side members with a window sash adapted for movement relative thereto.

BRIEF SUMMARY OF THE INVENTION

In accordance with my invention, I provide a positioner for a window sash adapted for movement relative to a window frame having spaced apart side members. A guide bracket is attached to the sash with one side of the guide bracket in spaced relation to and facing an adjacent side member carried by the window frame. The guide bracket extends in a plane which is inclined relative to a plane extending in the direction of movement of the sash with the opposite side of the guide bracket being parallel to the side thereof which faces the adjacent side member. One side of a wedge-like member is in sliding engagement with the side of the guide bracket facing the adjacent side member of the window frame. The opposite side of the wedge-like member extends parallel to and faces the adjacent side member of the window frame with the wedge-like member being movable into and out of engagement with the adjacent side member in response to sliding movement of the wedge-like member in opposite directions. An actuator is mounted for sliding movement along the opposite side of the guide bracket and is operatively connected to the wedge-like member to move it selectively into and out of engagement with the adjacent side member of a window frame. Resilient means urges the wedge-like member in a direction for it to move into engagement with an adjacent side member of a window frame.

DESCRIPTION OF THE DRAWINGS

Apparatus embodying features of my invention is illustrated in the accompanying drawings, forming a part of this application, in which:

FIG. 1 is an elevational view showing my improved window sash positioner installed on a conventional window frame;

FIG. 2 is an enlarged, fragmental view showing the sash positioner and adjacent portions of the window sash and an adjacent side member of the window frame;

FIG. 3 is a fragmental, sectional view taken generally along the line 3—3 of FIG. 2;

FIG. 4 is a sectional view taken generally along the line 4—4 of FIG. 2;

FIG. 5 is a sectional view taken generally along the line 5—5 of FIG. 2 and showing the sash positioner in the operative or engaged position relative to an adjacent side member of the window frame;

FIG. 6 is a sectional view corresponding to FIG. 5 showing the positioner moved to the inoperative or disengaged position relative to the adjacent side member of the window frame;

DETAILED DESCRIPTION

Figure 7:
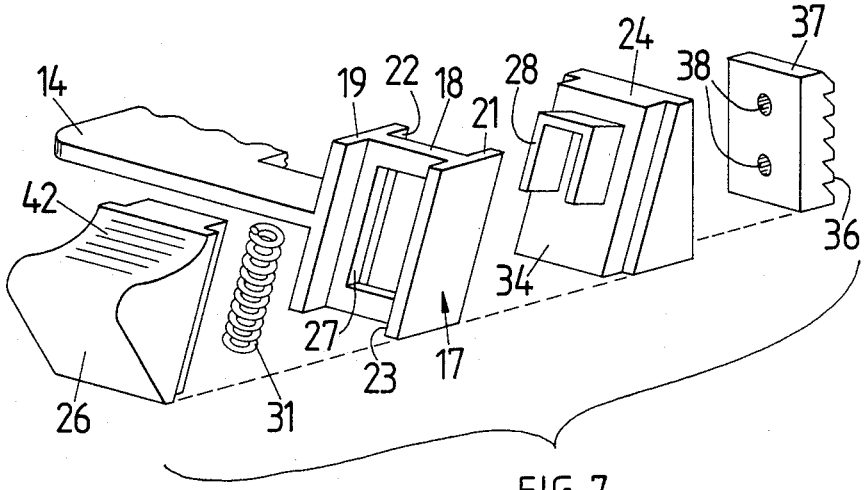
FIG. 7 is an exploded view showing the various components of the sash positioner; and, FIG. 8 is an exploded view showing the opposite side of the various components of the positioner from that shown in FIG. 7.

Referring now to the drawings for a better understanding of my invention, I show my improved sash positioner 10 as being mounted adjacent each lower corner of a window sash 11. The window sash 11 is mounted within a conventional window frame 12 having spaced apart side members 13, as shown.

My improved sash positioner 10 is shown as being carried by an L-shaped bracket 14 attached to the lower rail 16 of the sash 11, as shown. The bracket 14 also serves as a handle for raising and lowering the sash 11 to selected positions.

The sash positioner comprises a guide bracket 17 which is shown as being in the form of an I-beam having a web 18 connected to oppositely disposed flanges 19 and 21 which define oppositely disposed, outwardly opening grooves or channels 22 and 23, as shown. The channel 22 at one side of the guide bracket 17 receives one side of a wedge-like member 24 with a sliding fit. The channel 23 at the other side of the guide bracket 17 receives an actuator 26 with a sliding fit.

Figure 8:
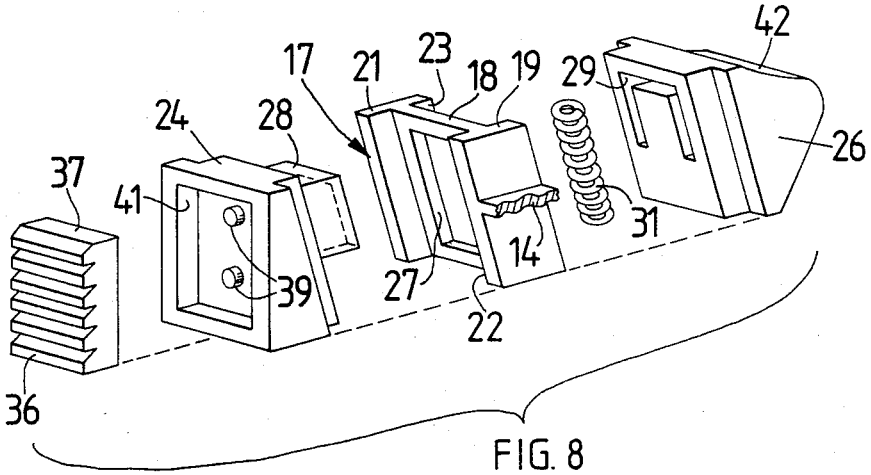

As clearly shown in FIGS. 7 and 8, the web 18 of the guide bracket 17 is provided with an elongated passageway 27 therethrough which extends in the direction of movement of the wedge-like member 17 relative to its guide bracket and in position to receive a connector member 28 having one end thereof connected to the wedge-like member 24 and the other end thereof connected to the actuator 26. As shown in FIG. 4, the connector member 28 is shown as being as inverted U-shaped member which is formed integrally with the wedge-like member 24. An inverted U-shaped recess 29 is provided in the side of the actuator 26 which extends inwardly of the channel 23 in position to receive the inverted U-shaped connector member 28 with a friction fit. Mounted within the passageway 27 is a compression spring 31 having one end thereof engaging the connector member 28 and the other end thereof engaging the lower end of the elongated passageway 27, as viewed in FIG. 4.

As clearly shown in FIGS. 4, 5 and 6, each guide bracket 17 is supported by the bracket 14 so that one side 32 thereof is in spaced relation to and faces the adjacent side member 13 of the window frame 12. The guide bracket 17 is also mounted on its support bracket 14 whereby it is inclined relative to a plane extending in the direction of movement of the window sash 11, as shown. The opposite side 33 of the guide bracket 17 is parallel to the side 32 whereby it also extends in a plane which is inclined relative to a plane extending in the direction of movement of the window sash 11.

The wedge-like member 24 is provided with a surface 34 at one side thereof which is in sliding engagement with the adjacent side 32 of the guide bracket 17. The opposite side of the wedge-like member 24 is provided with a surface 36 which extends parallel to and faces the side member 13 adjacent thereto. The surface 36 of the wedge-like member 24 is preferably carried by a resilient pad-like member 37 which is secured to the wedge-like member 24 by suitable means, such as shown in FIGS. 4–8. That is, suitable recesses 38 are provided in the pad-like member 37 in position to receive projections 39 carried by the wedge-like member 24. As shown in FIG. 8, the wedge-like member 24 is provided with a recess 41 therein for receiving the pad-like member 37.

The actuator 26 mounted for sliding movement along the side 33 of the guide bracket 17 and connected to the wedge-like member 24 by the connector member 28 is provided with a suitable thumb engaging surface 42 whereby it may be depressed from the position shown in FIG. 5 to the position shown in FIG. 6 to thus move the surface 36 of the wedge-like member out of engagement with the side member 13 of the window frame 12. Upon release of the actuator 26, the spring 31 urges the connector member 28 and the wedge-like member 24 back to their original positions, as shown in FIGS. 4 and 5, whereby the resilient surface 36 is urged into engagement with the adjacent side member 13 of the window frame. Accordingly, the wedge-like member 24 is movable into and out of engagement with the side member 13 of the window frame in response to sliding movement of the wedge-like member 24 in opposite directions.

From the foregoing, it will be seen that I have devised an improved positioner for a movable window sash which is adapted for movement relative to a window frame having spaced apart side members. By providing a wedge-shaped movable locking member supported by a guide bracket which is spaced from and faces the adjacent side member of the window frame and extends in a plane which is inclined relative to a plane extending in the direction of movement of the window sash, the contact surface of my improved locking member remains parallel to the adjacent side member of the window frame at all times. Accordingly, a maximum area of contact is maintained between the contact surface of the locking member and the adjacent surface of the side member of the window frame each time the movable locking member moves into engagement with the adjacent side member. Also, immediately upon release of the actuator 26, the wedge-like locking member 24 returns to its operative or engaged position with the adjacent surface of the side member 13 of the window frame, as shown in FIG. 5. Accordingly, the window sash 11 is released for downward movement only while the actuator member 26 is depressed, thus assuring that the window sash 11 will not fall accidentally to cause injury to a person or damage to the window sash.

While I have shown my invention in but one form, it will be obvious to those skilled in the art that it is not so limited, but is susceptible of various changes and modifications without departing from the spirit thereof.

What I claim is:

1. In a positioner for a movable window sash adapted for movement relative to a window frame having spaced apart side members, (a) a guide bracket carried by said sash with one side of said guide bracket being in spaced relation to and facing at least one of said side members and extending in a plane which is inclined relative to a plane extending in the direction of movement of said sash with the opposite side of said guide bracket being parallel to said one side of said guide bracket, (b) a wedge-like member having a first surface at one side thereof in sliding engagement with said one side of said guide bracket and a second surface at the opposite side thereof extending parallel to and facing said side member adjacent thereto with said wedge-like member being movable into and out of engagement with said side member adjacent thereto in response to sliding movement of said wedge-like member in a first direction and a second direction, respectively, (c) an actuator mounted for sliding movement along said opposite side of said guide bracket and operatively connected to said wedge-like member to move said wedge-like member selectively in said first direction and said second direction, and (d) resilient means urging said wedge-like member in said first direction and into engagement with said side member adjacent thereto.

2. A positioner for a movable window sash as defined in claim 1 in which said second surface of said wedge-like member facing said side member adjacent thereto is resilient.

3. A positioner for a movable window sash as defined in claim 1 in which said second surface of said wedge-like member is carried by a resilient pad-like member secured to said opposite side of said wedge-like member.

4. A positioner for a movable window sash as defined in claim 1 in which said resilient means urging said wedge-like member in said first direction is a spring member.

5. A positioner for a movable window sash as defined in claim 1 in which said guide bracket is in the form of a section of an I-beam having a web connected to oppositely disposed flanges and defining oppositely disposed, outwardly opening channels with one channel defining said one side of said guide bracket and receiving said wedge-like member with a sliding fit and the other channel defining said opposite side of said guide bracket and receiving said actuator with a sliding fit.

6. A positioner for a movable window sash as defined in claim 5 in which said web is provided with an elongated passageway therethrough which extends in the direction of movement of said wedge-like member and a connector member extends through said passageway with one end of said connector being connected to said wedge-like member and the other end thereof being connected to said actuator and a spring member is mounted within said passageway between said connector member and one end of said passageway.

* * * * *